US010722042B2

(12) United States Patent
Cailley et al.

(10) Patent No.: US 10,722,042 B2
(45) Date of Patent: Jul. 28, 2020

(54) ELEMENT OF ADJUSTABLE STIFFNESS FOR BEDS OR SEATS

(71) Applicant: TOURNADRE SA STANDARD GUM, Bourges (FR)

(72) Inventors: Géraud Cailley, Bourges (FR); Pascal Lobry, Bourges (FR); Jacques Lobry, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 60 days.

(21) Appl. No.: 15/978,353

(22) Filed: May 14, 2018

(65) Prior Publication Data

US 2018/0325273 A1 Nov. 15, 2018

(30) Foreign Application Priority Data

May 12, 2017 (FR) ..... 17 54172

(51) Int. Cl.

| | |
|---|---|
| ***A47C 23/04*** | (2006.01) |
| ***A47C 23/043*** | (2006.01) |
| ***A47C 23/06*** | (2006.01) |
| ***A47C 27/06*** | (2006.01) |
| ***A47C 23/00*** | (2006.01) |
| *A47C 23/05* | (2006.01) |

(52) U.S. Cl.

CPC ..... *A47C 23/0435* (2013.01); *A47C 23/002* (2013.01); *A47C 23/04* (2013.01); *A47C 23/0438* (2013.01); *A47C 23/067* (2013.01); *A47C 27/065* (2013.01); *A47C 23/05* (2013.01)

(58) Field of Classification Search

CPC . A47C 23/002; A47C 23/0435; A47C 27/056; A47C 27/061

USPC ..... 5/16–19, 446–448, 697; 267/103, 110

See application file for complete search history.

(56) References Cited

U.S. PATENT DOCUMENTS

| | | | | |
|---|---|---|---|---|
| 2,323,286 A | | 6/1943 | Ward | |
| 2,842,784 A | | 7/1958 | Grund | |
| 2,985,895 A | | 5/1961 | Bloom | |
| 3,084,926 A | | 4/1963 | Lemelson | |
| 3,608,107 A | * | 9/1971 | Kentor et al. ..... | A47C 27/061 5/716 |

(Continued)

FOREIGN PATENT DOCUMENTS

| | | |
|---|---|---|
| DE | 20318252 U1 | 2/2005 |
| DE | 202005006399 U1 | 9/2006 |

(Continued)

*Primary Examiner* — Christopher P Schwartz

(74) *Attorney, Agent, or Firm* — The Webb Law Firm

(57) ABSTRACT

The invention relates to the field of beds or seats. In particular, the invention relates to a flexible element (10) stiffness that is adjustable stiffness along a compression axis (Z), the element including a compression spring (50). In order to enable the stiffness of the stiffness element (10) to be adjusted, it further comprises both a mechanism (150) coupled to the compression spring (50) so as to be actuated by compression of the compression spring (50) along the compression axis (Z) to move in a direction other than the direction of the compression axis (Z), and also an adjustment device for selectively restricting or releasing the movement of the mechanism (150). The invention also provides a unit (200) comprising a plurality of such flexible elements (10), and a method of adjusting the stiffness of the flexible element (10).

18 Claims, 14 Drawing Sheets

(56) References Cited

U.S. PATENT DOCUMENTS

| | | | | | |
|---|---|---|---|---|---|
| 4,222,137 | A * | 9/1980 | Usami | A47C 23/0435 | 5/697 |
| 4,667,357 | A * | 5/1987 | Fortune | A47C 23/0435 | 5/697 |
| 6,427,990 | B1 * | 8/2002 | Hartmann | A47C 23/002 | 267/103 |
| 6,684,435 | B1 * | 2/2004 | Wells | A47C 27/062 | 5/248 |
| 6,826,791 | B2 * | 12/2004 | Fromme | A47C 23/002 | 267/103 |
| 7,636,971 | B2 * | 12/2009 | DeMoss | A47C 27/061 | 5/716 |
| 7,805,790 | B2 * | 10/2010 | DeMoss | A47C 27/062 | 5/716 |
| 9,468,306 | B2 | 10/2016 | Lobry | | |
| 2004/0123384 | A1 | 7/2004 | Fromme | | |
| 2008/0209644 | A1 * | 9/2008 | Wieland | A47C 23/002 | 5/719 |
| 2018/0325273 | A1 | 11/2018 | Cailley | | |
| 2018/0325275 | A1 * | 11/2018 | Cailley | A47C 23/002 | |

FOREIGN PATENT DOCUMENTS

| | | | |
|---|---|---|---|
| DE | 102008050108 | A1 | 4/2010 |
| EP | 1155643 | A2 | 11/2001 |
| EP | 1386564 | A1 | 2/2004 |
| EP | 2526835 | A1 | 11/2012 |
| EP | 2803297 | A1 | 11/2014 |
| EP | 3087873 | A1 | 11/2016 |
| WO | 9627312 | A1 | 9/1996 |
| WO | 2008015235 | A1 | 2/2008 |

* cited by examiner

ELEMENT OF ADJUSTABLE STIFFNESS FOR BEDS OR SEATS

CROSS-REFERENCE TO RELATED APPLICATION

This application claims priority to French Patent Application No. 1754172 filed May 12, 2017, the disclosure of which is hereby incorporated in its entirety by reference.

BACKGROUND OF THE INVENTION

The present disclosure relates to the field of furnishing and more particularly to a flexible element of adjustable stiffness for beds or seats, to a unit comprising a plurality of such flexible elements of adjustable stiffness, and to a method of adjusting the stiffness of a flexible element for beds or seats.

In order to enable the surface of a seat, a back, or a bed to be adaptable to the preferences and to the anatomy of various different users, units such as mattresses or box springs have previously been disclosed that comprise flexible elements of adjustable stiffness, e.g. in EP 1 386 564 A1, EP 1 155 643 A2, WO 2008/015235, WO 96/27312, U.S. Pat. No. 4,667,357, or DE 10 2008 050 108 A1. Typically, the stiffness of the elements therein is adjusted by applying restrictions on their mechanical deformation. To do that, the proposed mechanisms nevertheless present considerable complexity and/or size.

OBJECT AND SUMMARY OF THE INVENTION

The present disclosure seeks to remedy those drawbacks by proposing a flexible element for beds or seats that is of adjustable stiffness along a compression axis, that is of simple structure, and that is of limited size.

In an aspect of this disclosure, this object can be achieved by the fact that the flexible element, comprising a compression spring, also comprises a mechanism that is coupled to the compression spring so as to be actuated by compression of the compression spring along the compression axis in order to move in a direction other than the direction of the compression axis.

By means of these provisions, it is possible to obtain a flexible element of stiffness that is easily adjustable by restricting the movement of the mechanism or by leaving it free to move. Specifically, when the movement of the mechanism is restricted by the adjustment device, it stiffens the compression spring, whereas when such movement is no longer restricted, the mechanism no longer opposes compression of the compression spring.

The mechanism may in particular comprise a resilient hinge cantilevered out from the compression spring in a direction orthogonal to the compression axis, with a twist axis orthogonal to the compression axis, and an adjustment device for selectively restricting and releasing turning of the resilient hinge about the twist axis. Such a mechanism may be easily integrated in the flexible element without occupying too much additional space around the spring.

The mechanism may also comprise a rod constrained to turn with the resilient hinge about the twist axis, and wherein the adjustment device comprises an abutment that is movable between a first position restricting turning movement of the rod about the twist axis and a second position releasing turning movement of the rod about the twist axis. The adjustment device can thus be implemented in particularly simple manner.

The adjustment device may comprise a rotary part secured to the abutment, the rotary part being suitable for turning about the compression axis between the first position and the second position.

The rod may be resiliently flexible. Thus, it may stiffen rather than block the resilient hinge when the turning movement of the rod is restricted in the first position of the abutment of the adjustment device. The rod may also be curved. When configured in this way, it may in particular extend around at least a portion of the compression spring so as to be arranged compactly relative thereto without enlarging the footprint of the flexible element on a plane perpendicular to the compression axis and without interfering with the compression of the compression spring.

In particular, the compression spring may be helical. Specifically, such a helical compression spring may be configured as a rod wound in a helix about the compression axis. The compression along the compression axis may then give rise to twisting stress in the helical rod about the helix. Thus, this twisting stress may in particular contribute to causing the resilient hinge and the rod secured thereto to turn about the twist axis.

The flexible element may in particular comprise a plurality of compression springs that are coaxial. In particular, this plurality of coaxial compression springs may comprise a plurality of identical coaxial compression springs that are angularly offset in mutually regular manner. It is thus possible to increase the lateral stability of the flexible element and reduce any risk of buckling in compression. Furthermore, the flexible element may have a plurality of mechanisms, each of which is coupled to a respective compression spring from the plurality of compression springs so as to be actuated by compression of the corresponding compression spring along the compression axis in order to move in a direction other than the direction of the compression axis, the adjustment device being suitable for selectively restricting and releasing movement of the plurality of mechanisms simultaneously. In particular, each mechanism may comprise a resilient hinge cantilevered out to the corresponding compression spring in a direction orthogonal to the compression axis, with a respective twist axis orthogonal to the compression axis. In this flexible element, the adjustment device may then be suitable for selectively restricting or releasing turning movement of each resilient hinge of the plurality of mechanisms relative to the corresponding twist axis.

Furthermore, each mechanism of the plurality of mechanisms may further comprise a rod that is constrained to turn about the corresponding twist axis with the corresponding resilient hinge. The adjustment device may then comprise a plurality of abutments movable between a first position restricting turning movement of the rods of the plurality of mechanisms about the corresponding twist axes and a second position releasing turning movement of the rods about the corresponding twist axes. The adjustment device can thus act simultaneously on the stiffness of a plurality of compression springs.

In order to avoid any risk of collision or interference between the rods of the plurality of mechanisms and the springs of the plurality of springs, two rods of the plurality of mechanisms may be connected together by a hinge. In particular, the hinge may comprise respective flexible sleeves receiving respective ends of the two rods. A flexible sleeve may in particular be split in order to facilitate flexing.

The plurality of compression springs may in particular comprise compression springs arranged mechanically in parallel and/or in series. It may also be made at least partially by injection molding. The injection molding may serve to facilitate producing flexible elements at least in part out of organic polymer material, in particular out of thermoplastic material. Nevertheless, other materials, e.g. metallic materials, and also other production methods, such as for example additive fabrication, may be used alternatively or in addition to organic polymer materials and to molding or extrusion, as appropriate.

In another aspect, the present disclosure relates to a seat, back, or bed unit having a plurality of such flexible elements. The unit may in particular be a box spring or a mattress.

In such a unit, the adjustment devices of flexible elements that are adjacent in the plurality of flexible elements may be mechanically coupled together for actuation in common. In particular, the unit may further include pivots mechanically coupling together adjustment devices of flexible elements that are adjacent among the plurality of flexible elements for actuation in common.

In yet another aspect, the present disclosure provides a method of adjusting the stiffness of a flexible element along a compression axis. The flexible element comprises a compression spring in alignment with the compression axis and a mechanism coupled to the compression spring so as to be actuated by compression of the compression spring along the compression axis in order to move in a direction other than the direction of the compression axis. The method of adjusting stiffness comprises a step of an adjustment device selectively restricting or releasing the movement of the mechanism.

BRIEF DESCRIPTION OF THE DRAWINGS

The invention can be well understood and its advantages appear better on reading the following detailed description of embodiments given as non-limiting examples. The description refers to the accompanying drawings, in which.

DETAILED DESCRIPTION OF THE INVENTION

Figure 1A:
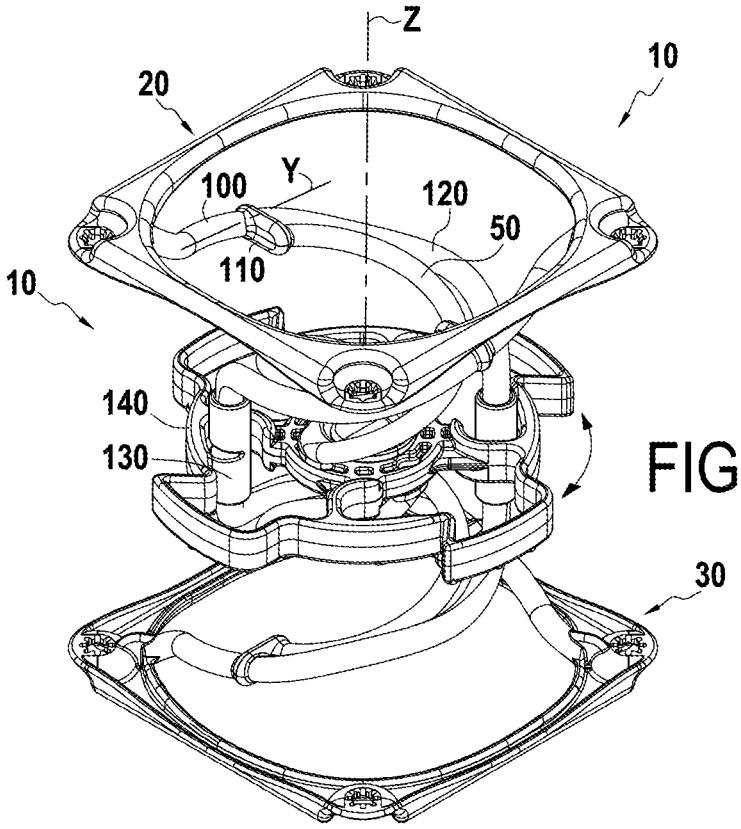
FIG. 1A is a perspective view of a relaxed flexible element of adjustable stiffness, with its adjustment device in its position of greater stiffness.

FIGS. 1A to 1D show a flexible element 10 for seats or beds and of stiffness along a compression axis Z that is adjustable. As shown more clearly in FIG. 2A, the flexible element 10 may comprise a plurality of resilient parts arranged in series along the compression axis Z. In particular, it may comprise a first resilient part 20 and a second resilient part 30 that are arranged mechanically in series along the compression axis Z and that are connected together by a connection 40 that may be situated in the center of the flexible element 10, as in the example shown.

Each of the two resilient parts 20 and 30 may comprise at least two compression springs 50 arranged mechanically in parallel, as in the example shown. In particular, these compression springs 50 may be helical springs as in the example shown in FIG. 1A, which springs are formed by rods wound in a helix H around the compression axis Z. Furthermore, in each of the resilient parts 20, 30, the angular offset around the compression axis Z between the helices of the helical and coaxial compression springs 50 may be regular. Thus, in the example shown, the angular offset between the compression springs 50 of each resilient part 20, 30 may be 360°/x, where x is the number of compression springs 50 in parallel in each resilient part 20, 30. Thus, by way of example, for a number x of compression springs 50 equal to two, the angular offset may be 180°.

In the example shown, each resilient part 20, 30 may also include a connector 60, 70 that is complementary respectively to the connector 70, 60 of the other resilient part 30, 20 so as to form the connection 40, together with a support platform 80, 90. The connectors 60, 70 and the support platforms 80, 90 may be arranged on opposite ends of the respectively resilient parts 20, 30. Thus, when the resilient parts 20, 30 are assembled in series, by connecting together their respective connectors 60, 70 so as to form the flexible element 10 as in the example shown, the flexible element 10 may extend from one of the support platforms 80, 90 to the other along the compression axis Z.

In each resilient part 20, 30 of the example shown, one end of each compression spring 50 may be connected directly to the respective connector 60, 70, while the other end may be connected to the support platforms 80, 90 via a respective resilient hinge 100. Each of the resilient hinges 100 may in particular present a twist axis Y that is substantially orthogonal to the compression axis Z and may be connected to the corresponding compression spring 50 via a more rigid arm 110 that extends in a radial direction substantially orthogonal to the compression axis Z and to the corresponding twist axis Y so that the resilient hinge 100 is cantilevered out from the compression spring 50 in a direction that is orthogonal to the compression axis Z. In the example shown, each resilient hinge 100 may be in the form of a torsion rod connecting the arm 110 to the support platforms 80, 90. Nevertheless, other forms can also be envisaged.

In addition, each resilient part 20, 30 in the example shown may also include other rods 120 that are secured to the arms 110. More specifically, each rod 120 may extend from a first end 121 that is secured to a corresponding arm 110 to a second end 122. Each second end 122 may be offset relative to the twist axis Y of the resilient hinge 100 corresponding to the arm 110 in a plane that is orthogonal to the twist axis Y so as to turn about the twist axis Y with the corresponding arm 110. In particular, between these first and second ends 121, 122, each rod 120 may be curved, and in particular may follow a helix that is greater than the helices of the compression springs 50 so as to extend around them so that the first and second ends 121, 122 of each rod 120 are situated on diametrically opposite sides of the springs 50, while also being mutually offset in a direction parallel to the compression axis Z. The rods 120 are also resiliently flexible.

Figure 2A:
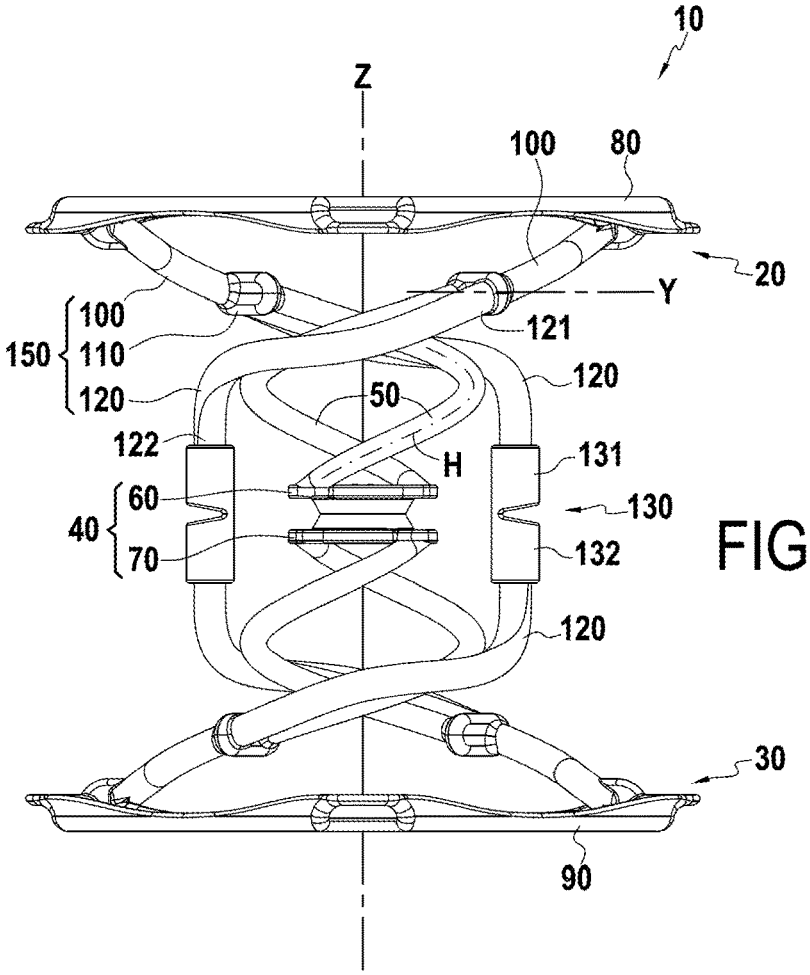
FIG. 2A is a side view of the FIG. 1A flexible element when relaxed, without its adjustment device.
Figure 2B:
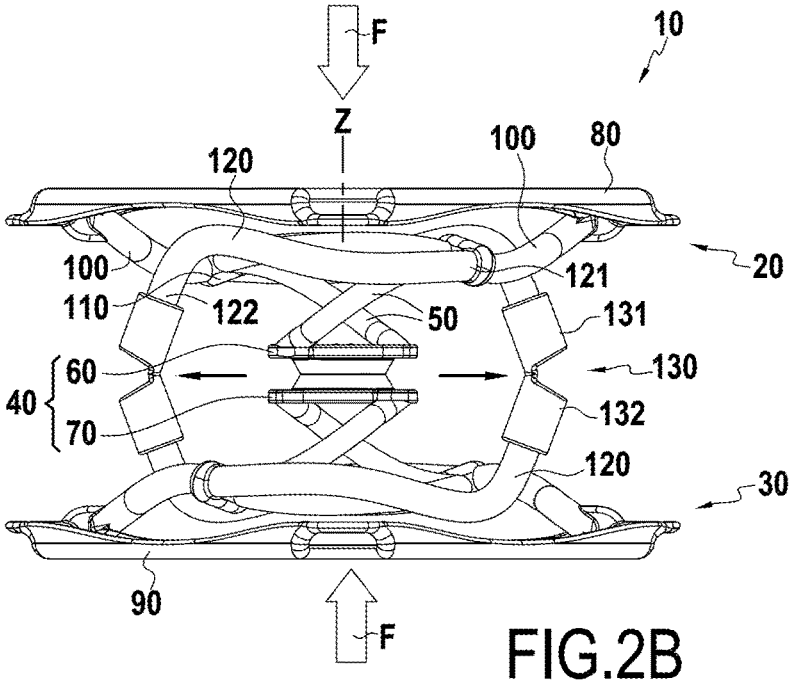
FIG. 2B is a side view of the FIG. 1A flexible element when compressed, without its adjustment device.

Thus, together with the corresponding arm 110 and rod 120, each resilient hinge 100 forms a mechanism 150 configured so that compressing the corresponding compression spring 50 along the compression axis Z causes the second end of the rod 120 to move radially relative to the compression axis Z, as shown in FIG. 2B.

In the example shown, the second end 122 of each rod 120 of one of the resilient parts 20, 30 may be connected by a hinge to the second end 122 of an opposite rod 120 of the other resilient part 30, 20. More specifically, the corresponding second ends 122 of each pair of opposite rods 120 may be received in opposite endpieces 131, 132 of a flexible sleeve 130 that can thus form such a hinge. The flexible sleeves 130 may in particular be split perpendicularly to their main axes so as to increase their flexibility.

Figure 1B:
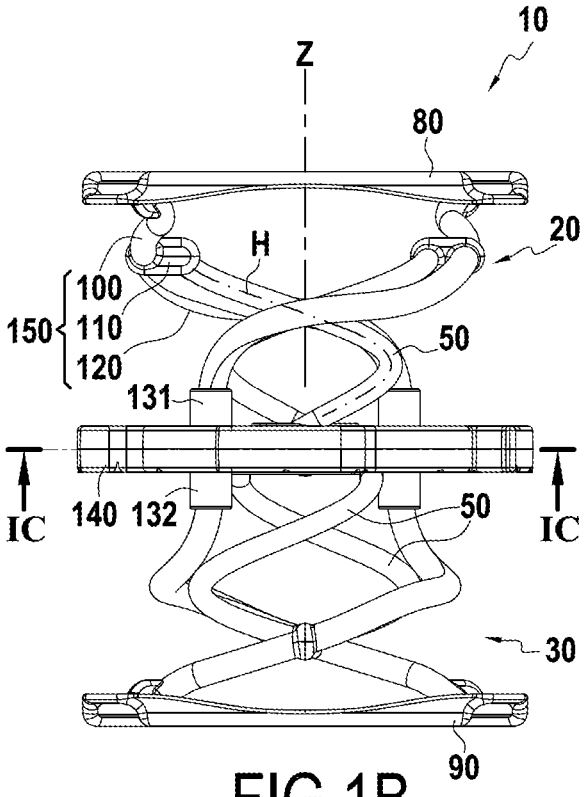
FIG. 1B is a side view of the FIG. 1A flexible element.
Figure 1C:
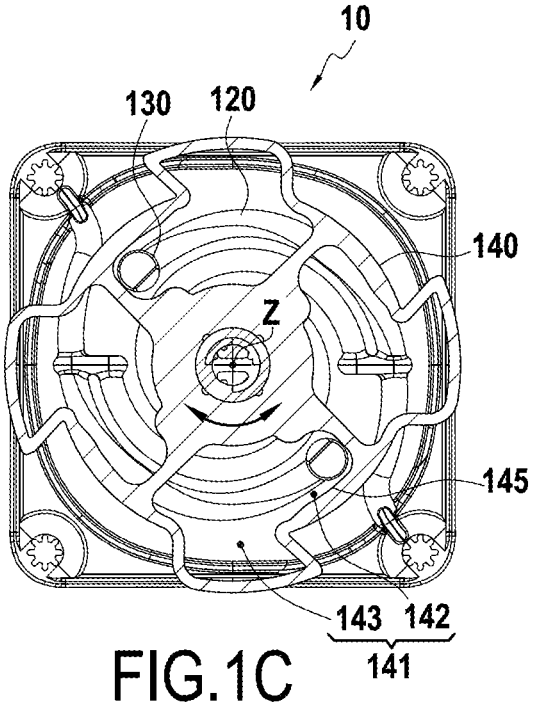
FIG. 1C is a section view of the FIG. 1B flexible element on plane IC-IC.
Figure 1D:
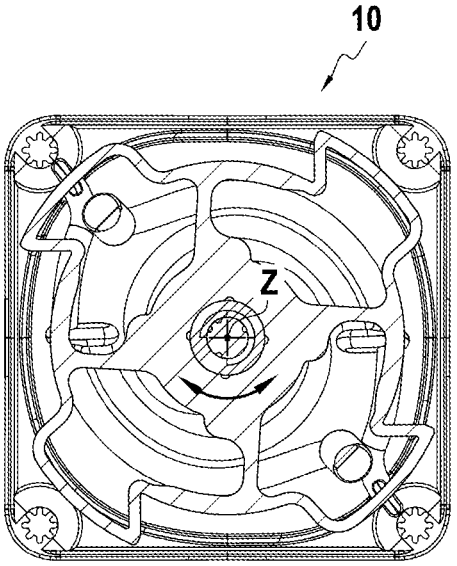
FIG. 1D is a section view of the FIG. 1C flexible element on the same plane, but with its adjustment device in its position of smaller stiffness.

Apart from the resilient parts 20, 30, the flexible element 10 may also include an adjustment device for adjusting the stiffness of the flexible element 10 along the compression axis Z. This adjustment device may in particular be configured as a rotary part 140, as shown in FIGS. 1A to 1C. This rotary part 140 may be held by the connectors 60, 70 so as to be turnable about the compression axis Z. As can be seen in particular in FIG. 1C, the rotary part 140 may have a plurality of openings 141 with the flexible sleeve 130 passing therethrough in a direction parallel to the compression axis Z. Each opening 141 may extend over a respective circular arc about the compression axis Z. More particularly, along this respective circular arc, each opening 141 may comprise a first section 142 and a second section 143, the first section 142 possibly being narrower than the second section 143 in the radial direction relative to the compression axis Z. More specifically, the outside edge of each opening 141 may be closer to the compression axis Z in the first section 142 than in the second section 143, thereby forming a radial abutment 145 for restricting radial movement of the corresponding flexible sleeve 130 relative to the compression axis Z, and thus also restricting radial movement of the second ends 122 of the rods 120 engaged in the flexible sleeve 130. The rotary part 140 can thus turn between a first position in which the flexible sleeves 130 are received in the first sections 142 of the openings 141 and the abutments 145 restrict radial outward movement of the flexible sleeve 130, and thus of the second ends 122 of the rods 120 relative to the compression axis Z, as shown in FIGS. 1A to 1C, and a second position in which the flexible sleeves 130 are received in the larger second sections 143 of the openings 141, thereby releasing the flexible sleeve 130 and the second ends 122 of the rods 120, as shown in FIG. 1D, so as to enable them to move radially further away form the compression axis Z, as shown in FIG. 2B.

The resilient parts 20, 30, the rotary part 140, and the flexible sleeves 130 may be made of organic polymer material, in particular of a thermoplastic material such as, for example: a polyamide, a polyoxymethylene, or a copolyester. Nevertheless, other materials, e.g. metallic materials, could be used alternatively or in combination with such polymer materials. The resilient parts 20, 30 and the rotary part 140 may in particular be molded, specifically injection molded. The flexible sleeves 130 may in particular be cut from an extruded part. Nevertheless, other production methods, such as for example additive fabrication, may be used as an alternative or in addition to molding or to extrusion.

The operation of the flexible element 10 of the example shown can thus be described with reference to FIGS. 1A to 2B. When the rotary part 140 forming a device for adjusting stiffness is in its second position, with the flexible sleeves 130 received in the larger second sections 143 of the openings 141, and the flexible element 10 is subjected to a compression force F along the compression axis Z between the support platforms 80, 90, the compression springs 50 are compressed and the arms 110 connecting them to the resilient hinges 100 turn about the respective twist axes Y together with the rods 120. As a result of the rods 120 turning about the respective twist axes Y, the second ends 122 of the rods 120 can move radially away from the compression axis Z without opposition over the width of the second sections 143 of the openings 141 of the rotary part 140, as shown in FIG. 2B. The flexible element 10 thus remains relatively flexible in compression.

Nevertheless, if the rotary part 140 is turned about the compression axis Z towards its first position in such a manner that the flexible sleeves 130 are received in the narrower first sections 142 of the openings 141, the abutments 145 can restrict outward radial movement relative to the compression axis Z of the flexible sleeves 130 and thus of the second ends 122 of the rods 120, thereby restricting turning of the rods 120 about the respective twist axes Y of the corresponding resilient hinges 100 when the flexible element 10 is subjected to compression F along the compression axis Z. Even though the rods 120 may be resiliently flexible so as to enable them to return to the initial relaxed position when the compression F ceases, restricting them by means of the abutments 145 serves indirectly also to restrict the turning of the arms 110 about the respective twist axes Y, thereby stiffening the resilient hinges 100 and possibly also the springs 50, since twisting about their respective helices can thus also be restricted indirectly. In this way, the flexible element 10 can thus present stiffness along the compression Z that is significantly greater when the rotary part 140 is in its first position than when the rotary part 140 is in its second position.

In order to form a bedding unit such as a mattress or a box spring, it is possible to group together a plurality of flexible elements of the kind described above. Thus, FIGS. 3A, 3B, 4A, 4B, 5A, and 5B show the core of a mattress 200 on a bed 300. The core of the mattress 200 may have a plurality of flexible elements 10 arranged in the example shown as a plurality of rows and columns in a plane perpendicular to the compression axes Z. The support platforms 80, 90 of adjacent flexible elements 10 may be connected together by flexible connections 210.

In order to enable the rotary parts 140 of all of the flexible elements to be actuated simultaneously so as to turn them simultaneously between their first and second positions, they may be mechanically coupled to one another. More specifically, as shown in detail in FIGS. 3C, 4C, and 5C, each of the rotary parts 140 may for example have at least one flexible blade 220 arranged at the periphery of the rotary part 140, extending in a plane perpendicular to the compression axis Z, and curved radially outwards relative to the compression axis Z.

Figure 3A:
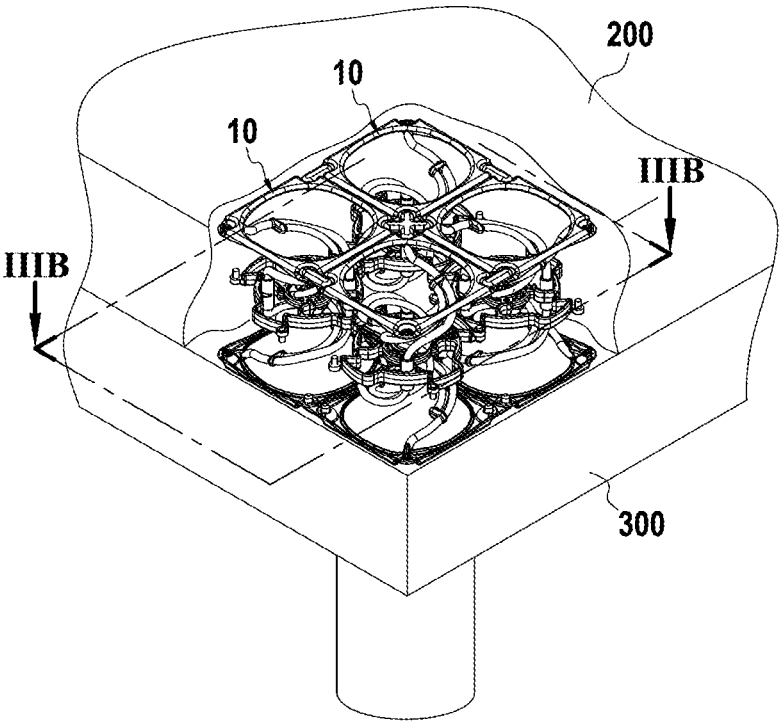
FIG. 3A is a perspective view of a unit comprising a plurality of flexible elements analogous to the element of FIG. 1A, in the position of greater stiffness.
Figure 3B:
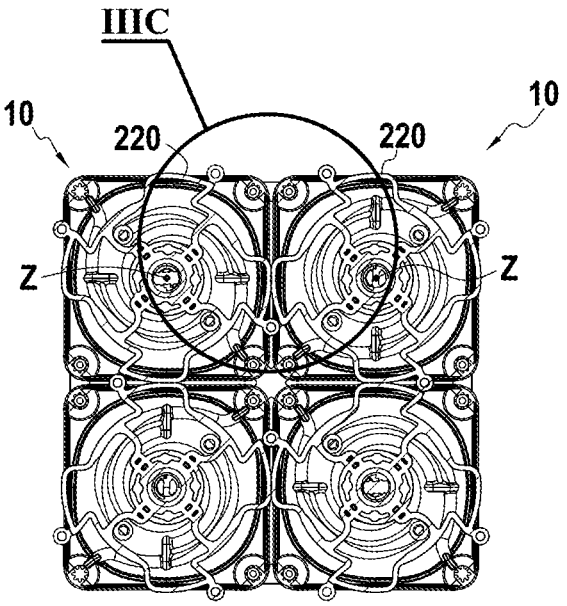
FIG. 3B is a section view of the FIG. 3A unit on plane IIIB-IIIB.
Figure 3C:
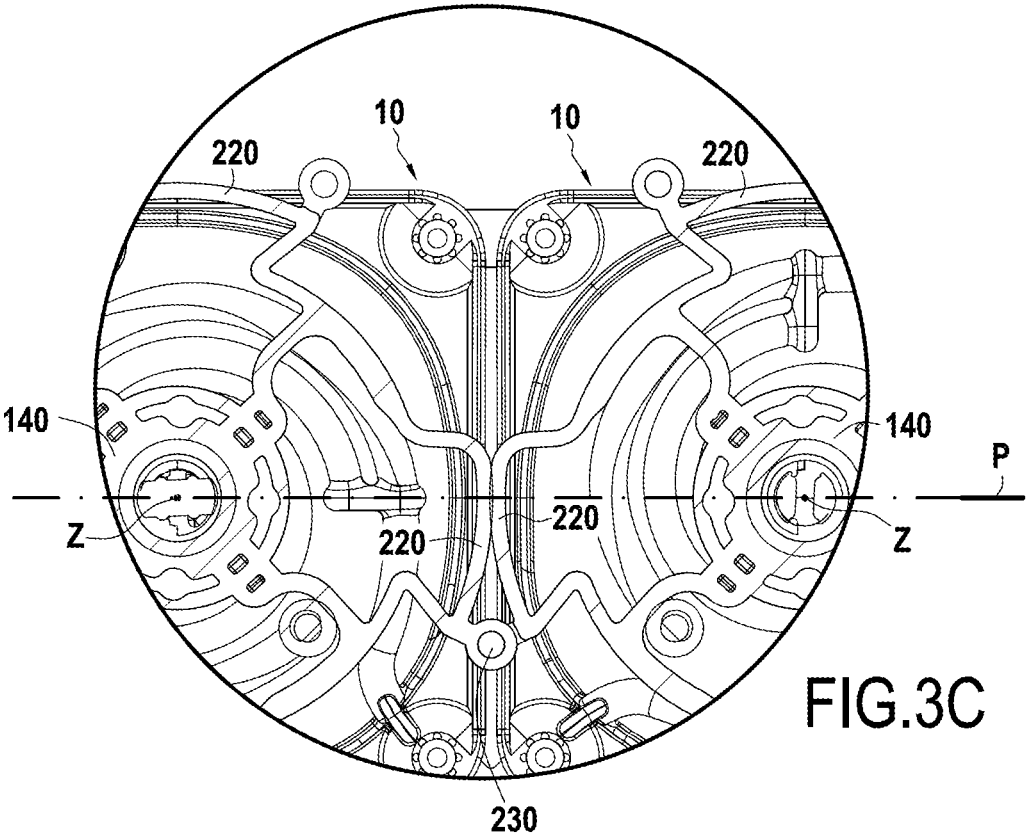
FIG. 3C is a detail of FIG. 3B.
Figure 4C:
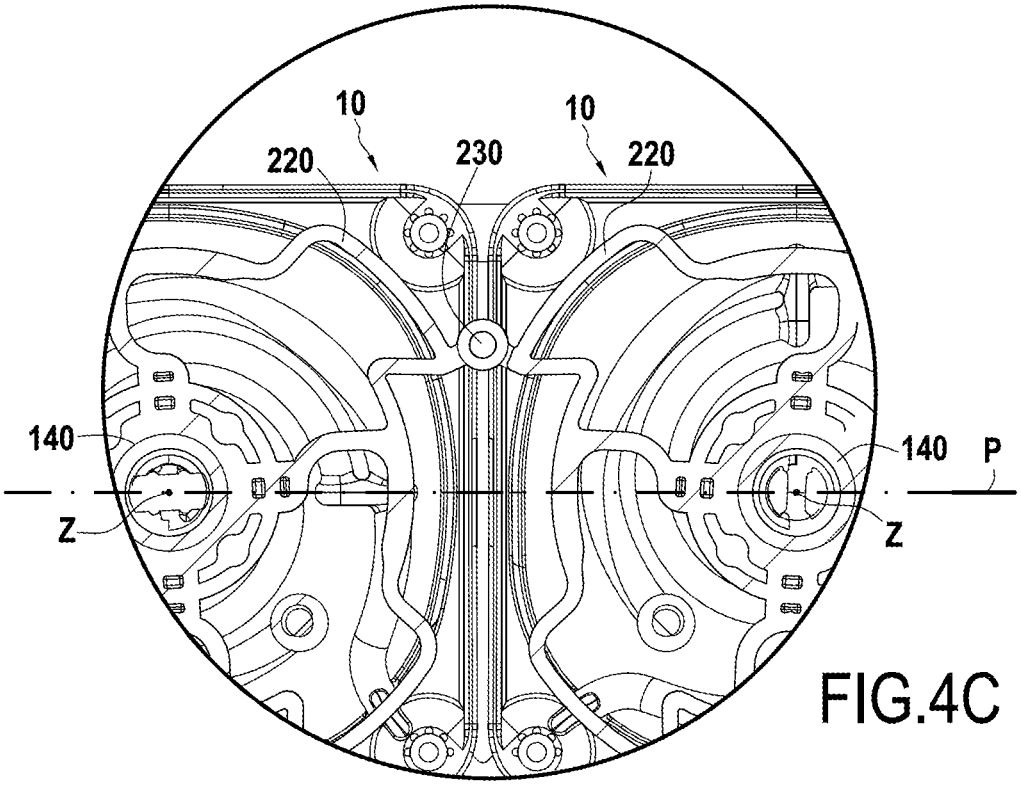
FIG. 4C is a detail of FIG. 4B.
Figure 4A:
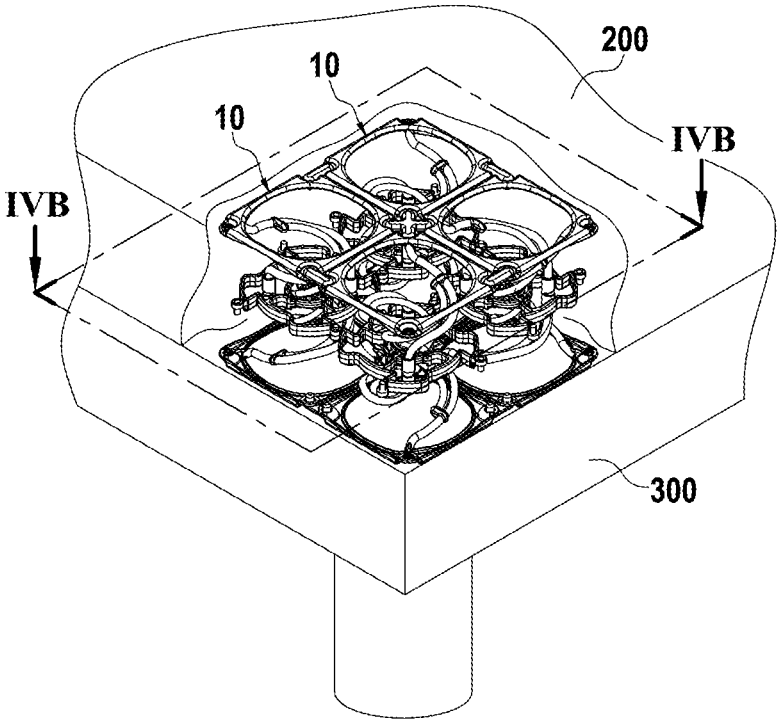
FIG. 4A is a perspective view of the FIG. 3A unit in its position of smaller stiffness.
Figure 4B:
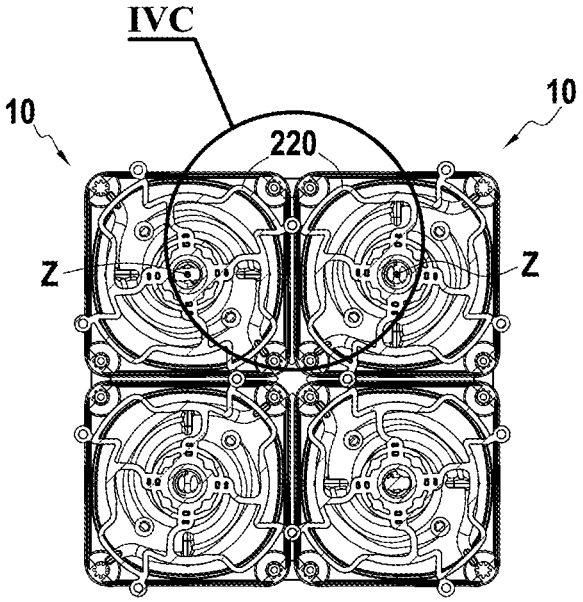
FIG. 4B is a section view of the FIG. 4A unit on plane IVB-IVB.
Figure 5A:
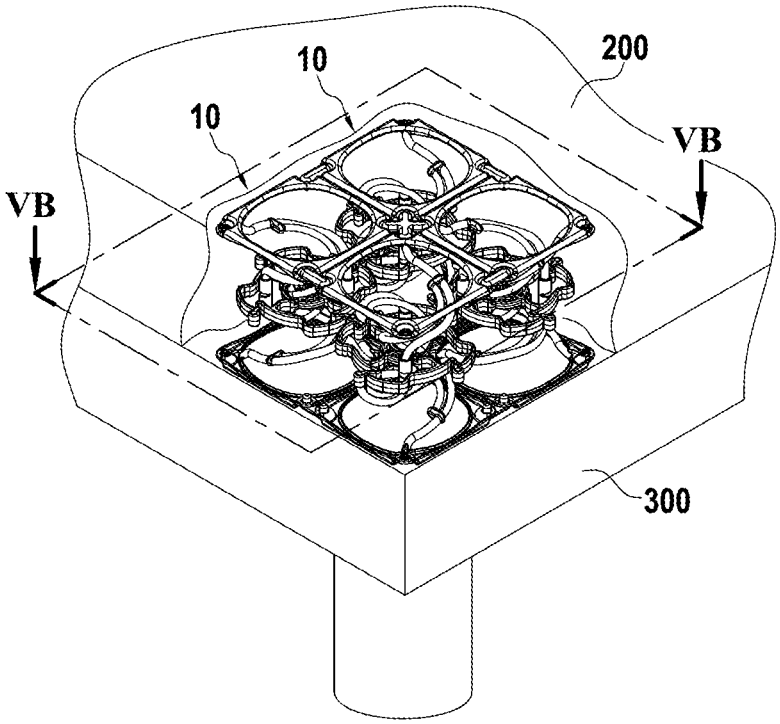
FIG. 5A is a perspective view of the FIG. 3A unit in an intermediate position.
Figure 5B:
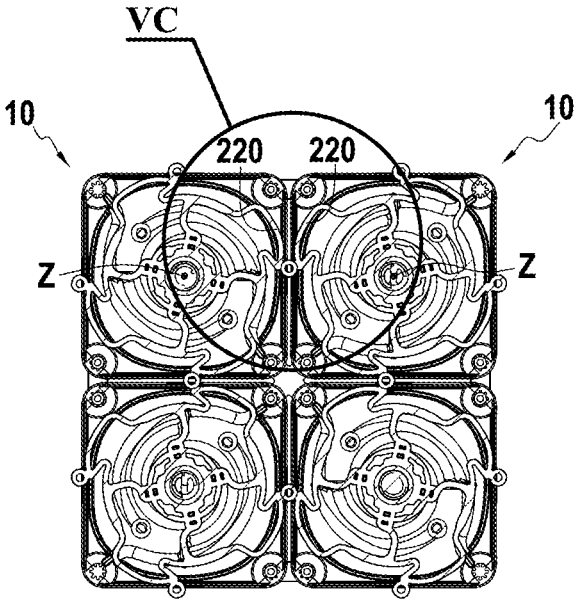
FIG. 5B is a section view of the FIG. 5A unit on plane VB-VB.
Figure 5C:
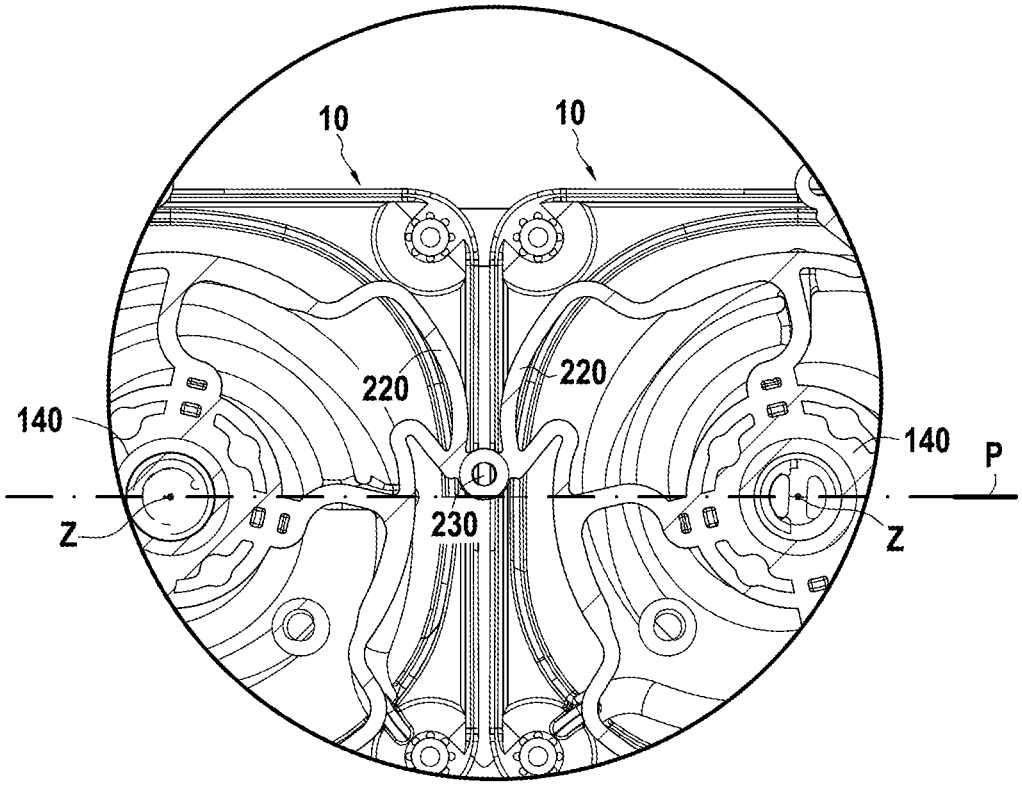
FIG. 5C is a detail of FIG. 5B.

Flexible blades 220 of rotary parts 140 of adjacent flexible elements 10 may be connected together by pivots 130 having pivot axes parallel to the compression axes Z of the flexible element 10. The distance between each pivot 230 and the compression axes Z of each of the two adjacent flexible elements 10 having their rotary parts 140 connected together by the pivots 230 may be greater than half the distance between the compression axes Z of the two adjacent flexible elements 10 so that when the rotary parts 140 of the adjacent flexible elements 10 are in their respective first positions, as shown in FIG. 3C, the pivot 230 is on one side of a flat plane P connecting together the compression axes Z of two adjacent flexible elements 10, and when the rotary parts 140 of the adjacent flexible elements 10 are in their second respective positions, as shown in FIG. 4C, the pivot 230 is on the other side of the plane P, and in order to move the rotary parts 140 of the adjacent flexible elements 10 from their first positions to their respective second positions, the pivot 230 needs to pass through an intermediate position in the plane P in which the flexible blades 220 are resiliently stressed against their respective curvatures towards the compression axes Z of their respective flexible elements 10, as shown in FIG. 5C.

Thus, the resilience of the flexible blades 220 makes it possible to deliver return forces respectively towards the first and second positions of the rotary parts 140 of the adjacent flexible elements 10 on either side of the intermediate position, thereby holding the first and second positions in stable manner and avoiding involuntary passage between them, and thus avoiding any involuntary change in the stiffness of the flexible elements 10. The user needs to make a conscious effort against the resilience of the flexible blades 220 in order to pass through the intermediate position so as to move the rotary parts 140 between their first and second positions.

Figure 6A:
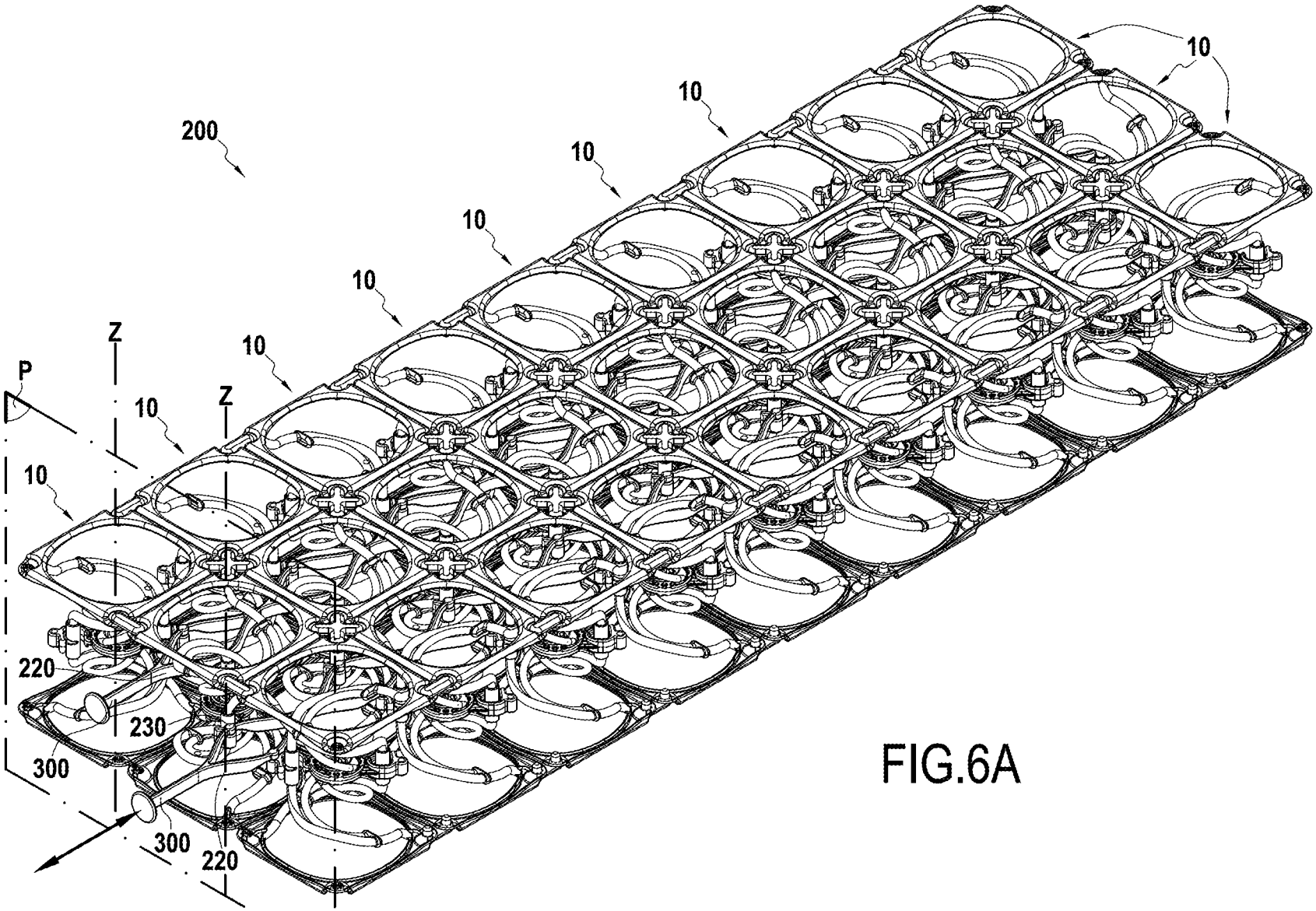
FIG. 6A is a perspective view of an alternative unit, likewise comprising a plurality of flexible elements of adjustment stiffness, in the position of greater stiffness.
Figure 6B:
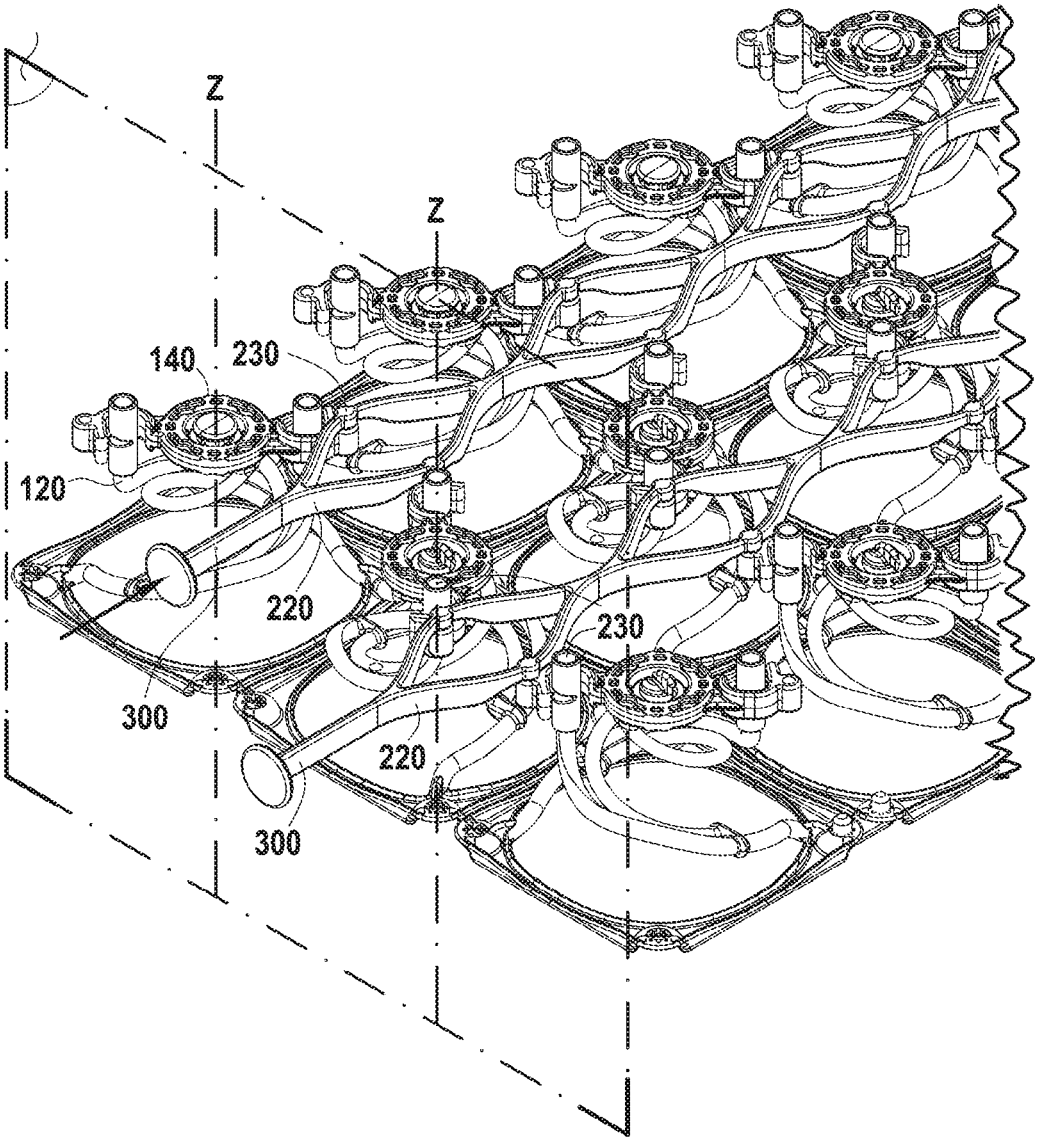
FIG. 6B is a partial perspective view of the FIG. 6A unit cut away on a plane VIB-VIB.
Figure 6C:
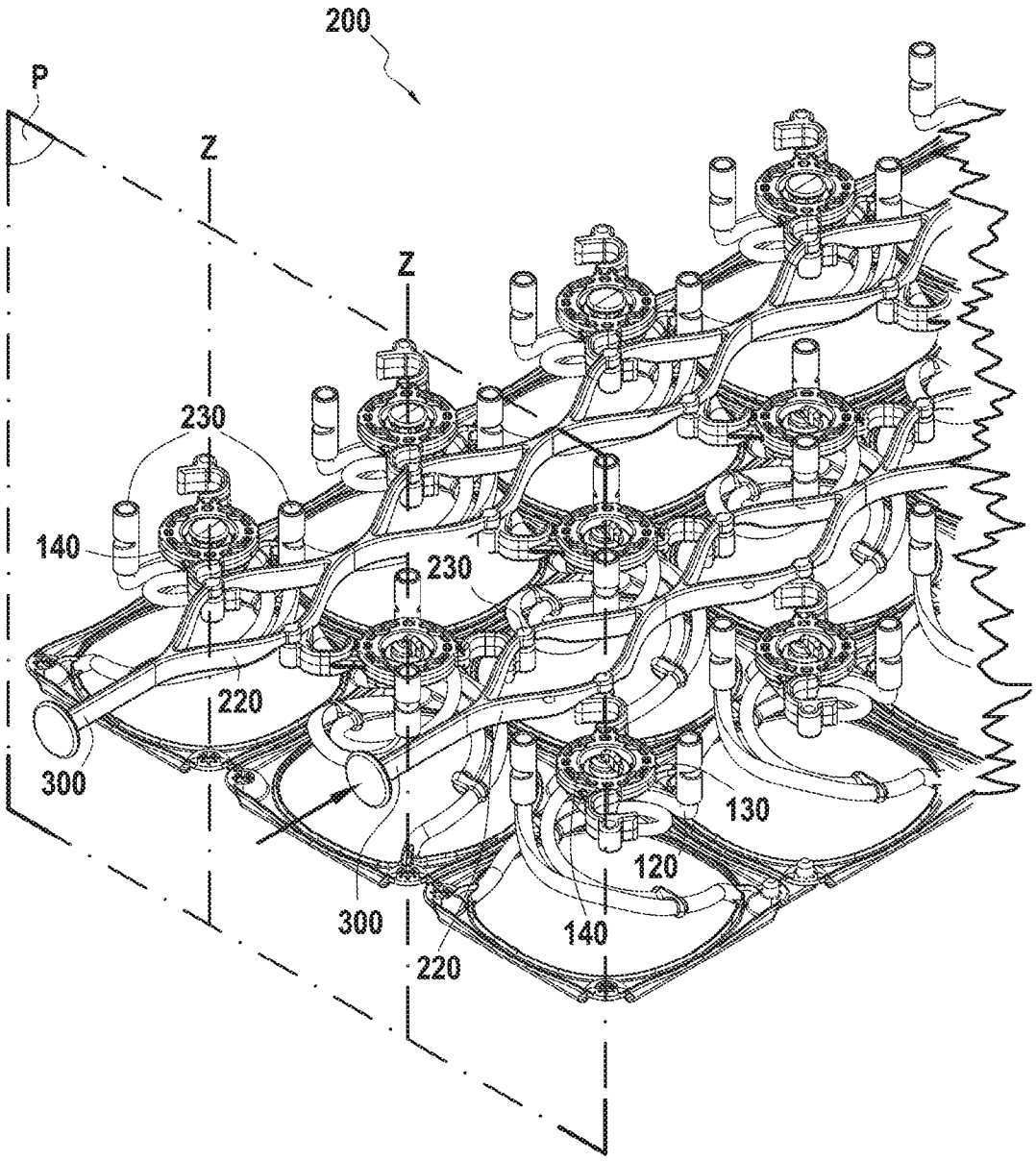
FIG. 6C is a partial perspective view of a FIG. 6A unit cut away on a plane VIB-VIB, in its position of smaller stiffness.
Figure 7A:
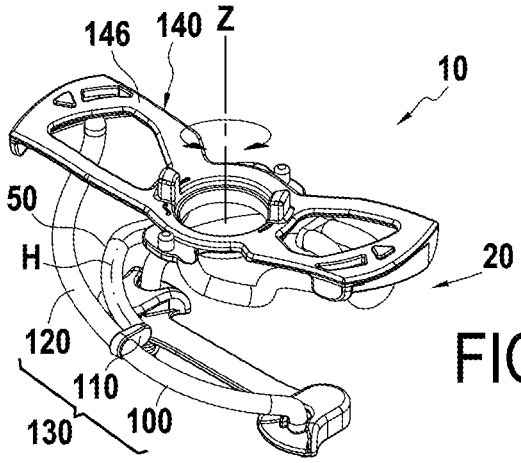
FIGS. 7A, 7B, and 7C are respectively a perspective view, a side view, and a view from above of an alternative flexible element of adjustment stiffness shown when relaxed and with its adjustment device in its position of greater stiffness.
Figure 7B:
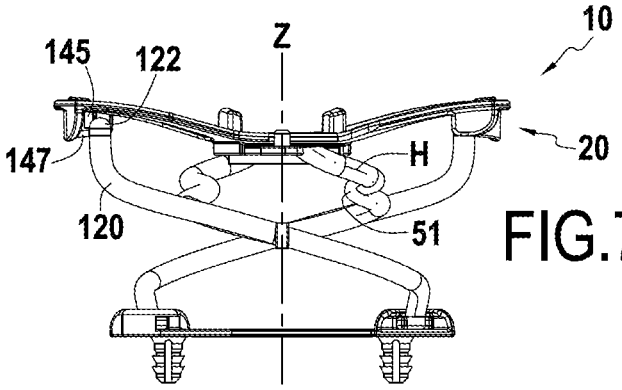
Figure 7C:
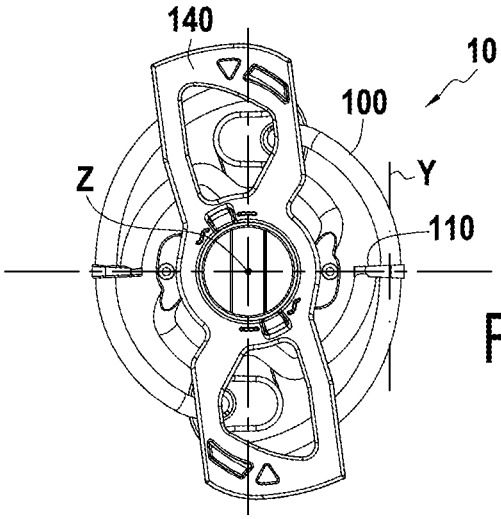
Figure 8A:
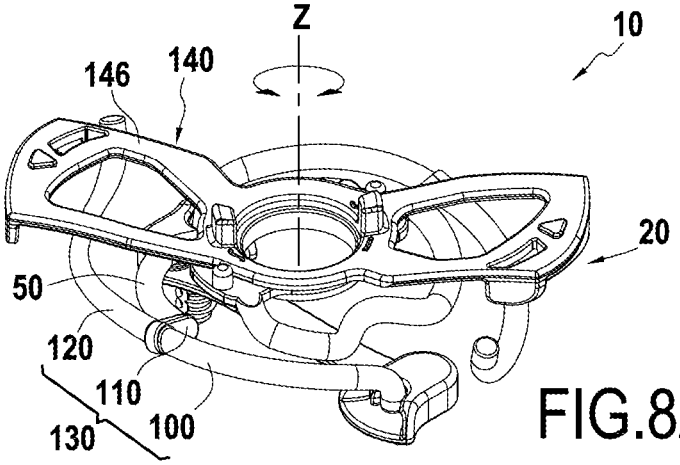
FIGS. 8A, 8B, and 8C are respectively a perspective view, a side view, and a view from above of an alternative flexible element of adjustable stiffness shown when compressed and with its adjustment device in its position of smaller stiffness.
Figure 8B:
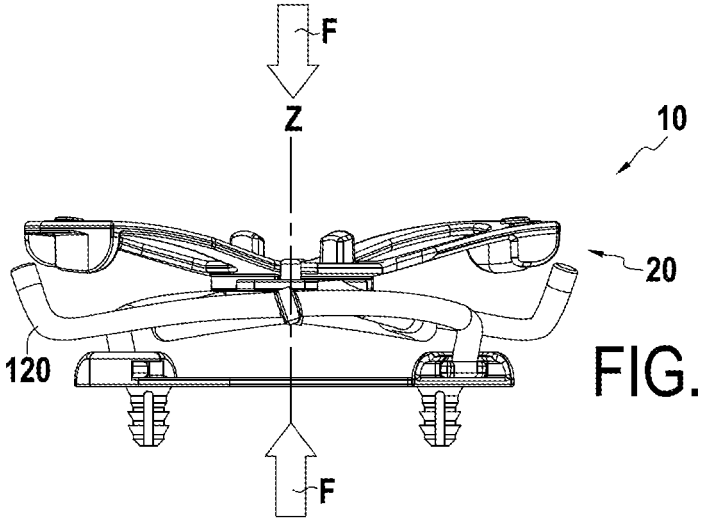
Figure 8C:
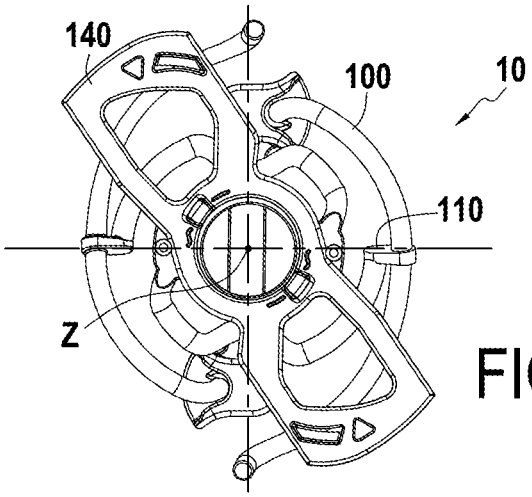

An alternative embodiment is shown in FIGS. 6A to 6C. In this alternative embodiment, the flexible elements 10 are similar to those of the first embodiment, and components that are analogous are consequently given the same reference numerals in the drawings. The rotary parts 140 in this second embodiment may be simpler than in the first embodiment merely having radial arms 146 carrying radial abutments 145 at their respective ends, but, as in the first embodiment, each rotary part 140 can turn between a first position in which these radial abutments 145 restrict radial outward movement relative to the compression axis Z of the flexible sleeves 130 and thus also of the second ends 122 of the rods 120 engaged in the flexible sleeves 130, and a second position in which the rotary part 140 no longer restricts this radial outward movement.

In addition, in this alternative embodiment, the pivots 230 need not connect the rotary parts 140 directly to adjacent rotary parts 140, but may connect them rather to control members 300 that may be arranged between the rows of flexible elements 10 and that can move in a straight line between the first and second positions. Furthermore, in this alternative example, the flexible blades 220 may be integrated in the control members 300 so that the control members 300 pass through an intermediate position between the first and second positions in which the flexible blades 220 are resiliently stressed against their respective curvatures.

Nevertheless, the principle of resilient stress in the intermediate position for ensuring return towards one or the other of the first and second positions can even be applied without using such curved flexible blades. Specifically, the flexible elements 10 may present resilience in bending perpendicularly to their compression axes Z so as to enable the rotary parts 140 when in their intermediate positions to move resiliently sideways between the first and second positions. Under such circumstances, the resilience of the flexible elements 10 perpendicularly to their compression axes Z may serve to deliver the return forces towards the first and second positions on either side of the intermediate position.

Figure 9A:
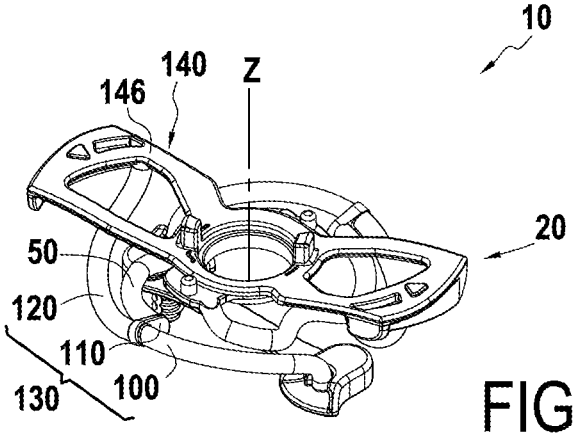
FIGS. 9A, 9B, and 9C show the alternative flexible element of FIGS. 8A to 8C when compressed and with its adjustment device in its position of greater stiffness.
Figure 9B:
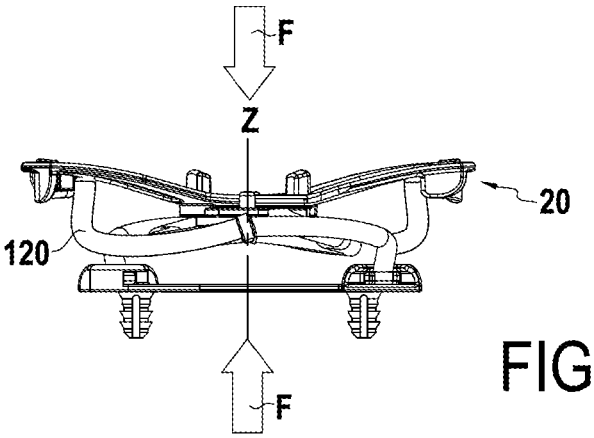
Figure 9C:
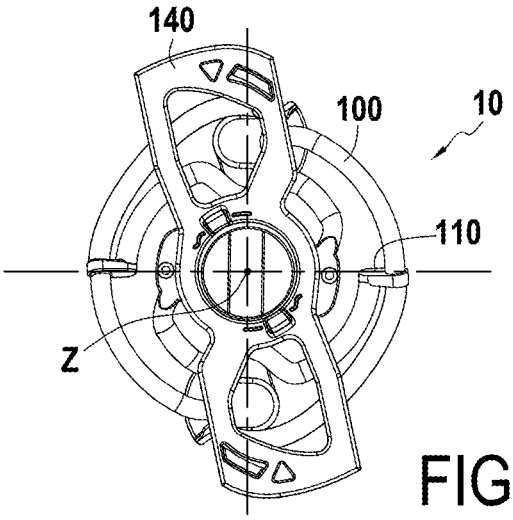

Although the present invention is described with reference to specific embodiments, it is clear that various modifications and changes may be undertaken on those embodiments without going beyond the general ambit of the invention as defined by the claims. Thus, FIGS. 7A to 9C show yet another example of a flexible element 10 that is intended for box springs rather than for mattresses. In this example, the flexible element 10 is similar to those of the first two embodiments, and analogous components are consequently given the same reference numerals in the drawings. This alternative flexible element 10 may comprise a single resilient part 20 and a rotary part 140. The resilient part 20 may have at least two compression springs 50 arranged mechanically in parallel as in the example shown. In particular, these compression springs 50 may be partially helical springs formed by rods wound in part around a helix H about the compression axis Z. As shown in the figures, the compression springs 50 may have bend segments 51 departing from the helix H so as to minimize the space they occupy, while limiting any risk of interference with other portions of the flexible element 10. The rotary part 140 may be similar to those of the second embodiment and have two radial arms 146 carrying catches 147 at their respective ends. These catches 147 may be configured in the first position of the rotary part 140 to receive the second ends 122 of the rods 120 so as to restrict their radial outward movement away from the compression axis Z when the compression springs 50 are compressed along the compression axis Z, as shown in FIGS. 9A to 9C. As in the above embodiments, the rotary part 140 may nevertheless turn between this first position and a second position in which the rotary part 140 no longer restricts this radial outward movement.

Furthermore, individual characteristics of the various examples and embodiments mentioned may be combined in additional embodiments. Consequently, the description and the drawings should be considered in a sense that is illustrative rather than restrictive.

The invention claimed is:

1. A flexible element for a piece of furniture for lying or sitting on, the element having stiffness that is adjustable along a compression axis and comprising:

a compression spring;

a mechanism coupled to the compression spring so as to be actuated by compression of the compression spring along the compression axis in order to move along a direction other than the direction of the compression axis, wherein the mechanism comprises a resilient hinge cantilevered out from the compression spring in a direction orthogonal to the compression axis, with a twist axis orthogonal to the compression axis, and the adjustment device is configured for selectively restricting and releasing turning of the resilient hinge relative to the twist axis; and an adjustment device for selectively restricting and releasing the movement of the mechanism.

2. The flexible element according to claim 1, having a plurality of coaxial compression springs.

3. The flexible element according to claim 2, having a plurality of mechanisms, each of which is coupled to a corresponding compression spring from the plurality of coaxial compression springs so as to be actuated by compression of the corresponding compression spring along the compression axis in order to move in a direction other than the direction of the compression axis, the adjustment device being suitable for selectively restricting and releasing movement of the plurality of mechanisms simultaneously.

4. The flexible element according to claim 3, wherein each mechanism of the plurality of mechanisms comprises a resilient hinge cantilevered out to the corresponding compression spring in a direction orthogonal to the compression axis, with a corresponding twist axis orthogonal to the compression axis, and wherein the adjustment device is suitable for selectively restricting or releasing turning movement of each resilient hinge of the plurality of mechanisms relative to the corresponding twist axis.

5. The flexible element according to claim 4, wherein each mechanism of the plurality of mechanisms further comprises a rod that is constrained to turn about the corresponding twist axis with the corresponding resilient hinge, and wherein the adjustment device comprises a plurality of abutments movable between a first position restricting turning movement of the rods of the plurality of mechanisms about the corresponding twist axes and a second position releasing turning movement of the rods of the plurality of mechanisms about the corresponding twist axes.

6. The flexible element according to claim 5, wherein two rods of the plurality of mechanisms are connected together by a hinge.

7. The flexible element according to claim 6, wherein the hinge comprises a flexible sleeve receiving the respective ends of the two rods.

8. The flexible element according to claim 2, wherein the plurality of compression springs comprises compression springs arranged mechanically in parallel and/or in series.

9. The flexible element according to claim 1, wherein the mechanism further comprises a rod constrained to turn with the resilient hinge about the twist axis, and wherein the adjustment device comprises an abutment that is movable between a first position restricting turning movement of the rod about the twist axis and a second position releasing turning movement of the rod about the twist axis.

10. The flexible element according to claim 9, wherein the adjustment device comprises a rotary part secured to the abutment, the rotary part being suitable for turning about the compression axis between the first position and the second position.

11. The flexible element according to claim 9, wherein the rod is resiliently flexible.

12. The flexible element according to claim 9, wherein the rod is curved.

13. A unit for a seat, back, or bed, comprising a plurality of flexible elements according claim 1.

14. The unit according to claim 13, wherein adjustment devices of adjacent flexible elements among the plurality of flexible elements are mechanically coupled together for actuation in common.

15. The unit according to claim 14, further including pivots mechanically coupling together the adjustment devices of the adjacent flexible elements among the plurality of flexible elements for actuation in common.

16. The flexible element according to claim 1, wherein the compression spring is helical.

17. The flexible element according to claim 1, made at least in part by injection molding.

18. A method of adjusting the stiffness along a compression axis of a flexible element for a piece of furniture for lying or sitting on, the element comprising a compression spring and a mechanism coupled to the compression spring so as to be actuated by compression of the compression spring along the compression axis in order to move in a direction other than the direction of the compression axis, the method comprising a step of:

an adjustment device selectively restricting or releasing the movement of the mechanism, wherein the mechanism further comprises a resilient hinge cantilevered out from the compression spring in a direction orthogonal to the compression axis, with a twist axis orthogonal to the compression axis, and the adjustment device is configured for selectively restricting and releasing turning of the resilient hinge relative to the twist axis.

* * * * *